US008899719B2

(12) United States Patent
Nagashima et al.

(10) Patent No.: US 8,899,719 B2
(45) Date of Patent: Dec. 2, 2014

(54) IMAGE FORMING METHOD AND IMAGE FORMING APPARATUS

(71) Applicants: Hidefumi Nagashima, Kanagawa (JP); Michihiko Namba, Kanagawa (JP); Kiyofumi Nagai, Tokyo (JP)

(72) Inventors: Hidefumi Nagashima, Kanagawa (JP); Michihiko Namba, Kanagawa (JP); Kiyofumi Nagai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/074,044

(22) Filed: Nov. 7, 2013

(65) Prior Publication Data

US 2014/0192112 A1 Jul. 10, 2014

(30) Foreign Application Priority Data

Jan. 7, 2013 (JP) ..... 2013-000604

(51) Int. Cl.

| | |
|---|---|
| ***B41J 2/015*** | (2006.01) |
| ***B41M 7/02*** | (2006.01) |
| ***B41M 7/00*** | (2006.01) |
| ***B41J 2/01*** | (2006.01) |
| *B41M 5/00* | (2006.01) |

(52) U.S. Cl.

CPC . *B41M 7/00* (2013.01); *B41M 7/02* (2013.01); *B41M 7/0018* (2013.01); *B41M 7/0036* (2013.01); *B41J 2/01* (2013.01); *B41M 5/0017* (2013.01); *B41M 7/0027* (2013.01)

USPC ..... 347/21; 347/95; 347/100

(58) Field of Classification Search

USPC ..... 347/20, 21, 95, 100, 56; 106/31.13, 106/31.6, 31.27, 31.37; 523/160, 161

See application file for complete search history.

(56) References Cited

U.S. PATENT DOCUMENTS

| | | | | |
|---|---|---|---|---|
| 4,647,310 | A | 3/1987 | Shimada et al. | |
| 4,711,668 | A | 12/1987 | Shimada et al. | |
| 4,793,860 | A | 12/1988 | Murakami et al. | |
| 5,431,720 | A | 7/1995 | Nagai et al. | |
| 5,462,592 | A | 10/1995 | Murakami et al. | |
| 5,514,208 | A | 5/1996 | Nagai et al. | |
| 5,622,550 | A | 4/1997 | Konishi et al. | |
| 5,810,915 | A | 9/1998 | Nagai et al. | |
| 5,879,439 | A | 3/1999 | Nagai et al. | |
| 5,882,390 | A | 3/1999 | Nagai et al. | |
| 5,972,082 | A | 10/1999 | Koyano et al. | |
| 5,993,524 | A | 11/1999 | Nagai et al. | |
| 6,010,564 | A * | 1/2000 | Zhu et al. | 106/31.37 |

(Continued)

FOREIGN PATENT DOCUMENTS

| | | |
|---|---|---|
| EP | 1223046 A2 | 7/2002 |
| EP | 1547793 A1 | 6/2005 |

(Continued)

OTHER PUBLICATIONS

U.S. Appl. No. 14/004,748, filed Mar. 9, 2012.

(Continued)

*Primary Examiner* — Juanita D Jackson

(74) *Attorney, Agent, or Firm* — Cooper & Dunham LLP

(57) ABSTRACT

An image forming method includes discharging an inkjet ink including a water-dispersible colorant, a wetter, a surfactant, a penetrant water-dispersible polyurethane resin having a median diameter of from 0.01 to 0.10 μm water and at least one of a polyethylene wax and a paraffin wax on the surface of the recording medium on which the inkjet ink is discharged.

10 Claims, 1 Drawing Sheet

(56) References Cited

U.S. PATENT DOCUMENTS

| | | | | |
|---|---|---|---|---|
| 6,120,589 | A | 9/2000 | Bannai et al. | |
| 6,231,652 | B1 | 5/2001 | Koyano et al. | |
| 6,261,349 | B1 | 7/2001 | Nagai et al. | |
| 6,613,136 | B1 | 9/2003 | Arita et al. | |
| 7,287,836 | B2 * | 10/2007 | Silverbrook | 347/56 |
| 2002/0083866 | A1 | 7/2002 | Arita et al. | |
| 2002/0096085 | A1 | 7/2002 | Gotoh et al. | |
| 2002/0135650 | A1 | 9/2002 | Nagai et al. | |
| 2002/0156153 | A1 | 10/2002 | Tsang et al. | |
| 2003/0010252 | A1 | 1/2003 | Arita et al. | |
| 2003/0038869 | A1 | 2/2003 | Kaneko et al. | |
| 2003/0064206 | A1 | 4/2003 | Koyano et al. | |
| 2003/0107632 | A1 | 6/2003 | Arita et al. | |
| 2004/0155946 | A1 | 8/2004 | Nagai | |
| 2004/0179066 | A1 | 9/2004 | Arita et al. | |
| 2004/0225031 | A1 | 11/2004 | Tsang et al. | |
| 2005/0007431 | A1 | 1/2005 | Koyano et al. | |
| 2005/0007433 | A1 | 1/2005 | Inoue et al. | |
| 2005/0054751 | A1 | 3/2005 | Namba et al. | |
| 2005/0168552 | A1 | 8/2005 | Arita et al. | |
| 2005/0174411 | A1 | 8/2005 | Adachi et al. | |
| 2005/0231575 | A1 | 10/2005 | Bannai et al. | |
| 2005/0243121 | A1 | 11/2005 | Onishi | |
| 2006/0176349 | A1 | 8/2006 | Nagai et al. | |
| 2007/0197685 | A1 | 8/2007 | Aruga et al. | |
| 2007/0221078 | A1 | 9/2007 | Namba et al. | |
| 2007/0221079 | A1 | 9/2007 | Aruga et al. | |
| 2008/0070008 | A1 | 3/2008 | Namba et al. | |
| 2008/0138519 | A1 | 6/2008 | Habashi et al. | |
| 2008/0248260 | A1 | 10/2008 | Kojima et al. | |
| 2008/0254228 | A1 | 10/2008 | Kojima et al. | |
| 2008/0273045 | A1 | 11/2008 | Morohoshi et al. | |
| 2008/0293881 | A1 | 11/2008 | Tsang et al. | |
| 2008/0302268 | A1 | 12/2008 | Arita et al. | |
| 2009/0098312 | A1 | 4/2009 | Goto et al. | |
| 2009/0114121 | A1 | 5/2009 | Morohoshi et al. | |
| 2009/0130313 | A1 | 5/2009 | Ohshima et al. | |
| 2009/0162569 | A1 | 6/2009 | Morohoshi et al. | |
| 2009/0176070 | A1 | 7/2009 | Goto et al. | |
| 2009/0186162 | A1 | 7/2009 | Namba et al. | |
| 2009/0239044 | A1 | 9/2009 | Habashi et al. | |
| 2009/0258196 | A1 | 10/2009 | Nagashima et al. | |
| 2009/0263632 | A1 | 10/2009 | Kojima et al. | |
| 2009/0291213 | A1 | 11/2009 | Ohshima et al. | |
| 2010/0194837 | A1 | 8/2010 | Ohshima et al. | |
| 2010/0196601 | A1 | 8/2010 | Goto et al. | |
| 2010/0196602 | A1 | 8/2010 | Koyano et al. | |
| 2010/0196603 | A1 | 8/2010 | Ohshima et al. | |
| 2010/0196673 | A1 | 8/2010 | Nagashima et al. | |
| 2010/0209611 | A1 | 8/2010 | Ohshima et al. | |
| 2010/0215855 | A1 | 8/2010 | Morohoshi et al. | |
| 2010/0227067 | A1 | 9/2010 | Namba et al. | |
| 2010/0245416 | A1 | 9/2010 | Ohshima et al. | |
| 2010/0265292 | A1 | 10/2010 | Ohshima et al. | |
| 2010/0271435 | A1 | 10/2010 | Kojima et al. | |
| 2010/0277541 | A1 | 11/2010 | Watanabe et al. | |
| 2010/0279035 | A1 | 11/2010 | Namba et al. | |
| 2010/0295891 | A1 | 11/2010 | Goto et al. | |
| 2010/0302326 | A1 | 12/2010 | Morohoshi et al. | |
| 2011/0057981 | A1 | 3/2011 | Aruga et al. | |
| 2011/0092610 | A1 | 4/2011 | Habashi et al. | |
| 2011/0164086 | A1 | 7/2011 | Ggoto et al. | |
| 2011/0205288 | A1 | 8/2011 | Matsuyama et al. | |
| 2011/0216123 | A1 | 9/2011 | Tamai et al. | |
| 2011/0300353 | A1 | 12/2011 | Habashi et al. | |
| 2011/0310166 | A1 | 12/2011 | Namba et al. | |
| 2011/0316947 | A1 | 12/2011 | Kojima et al. | |
| 2012/0098883 | A1 | 4/2012 | Matsuyama et al. | |
| 2012/0236066 | A1 | 9/2012 | Tamai et al. | |
| 2012/0293582 | A1 | 11/2012 | Goto et al. | |
| 2012/0320133 | A1 | 12/2012 | Namba et al. | |
| 2012/0328853 | A1 | 12/2012 | Matsuyama et al. | |
| 2013/0002776 | A1 | 1/2013 | Nagashima et al. | |
| 2013/0113860 | A1 | 5/2013 | Gotou et al. | |
| 2013/0194345 | A1 | 8/2013 | Tamai at al. | |
| 2013/0201252 | A1 | 8/2013 | Namba | |

FOREIGN PATENT DOCUMENTS

| | | |
|---|---|---|
| JP | 2004-106456 | 4/2004 |
| JP | 2005-035277 | 2/2005 |
| JP | 2007-112043 | 5/2007 |
| JP | 2008-213199 | 9/2008 |
| JP | 2009-160867 | 7/2009 |
| JP | 2010-023265 | 2/2010 |
| JP | 2010-105187 | 5/2010 |
| JP | 2010-105228 | 5/2010 |
| JP | 2010-115854 | 5/2010 |
| JP | 2010-173286 | 8/2010 |
| JP | 2010-221670 | 10/2010 |
| JP | 2011-063016 | 3/2011 |
| JP | 2011-105899 | 6/2011 |
| JP | 2011-105900 | 6/2011 |
| JP | 2011-194823 | 10/2011 |
| JP | 2011-194826 | 10/2011 |
| JP | 2011-207146 | 10/2011 |
| JP | 2012-091505 | 5/2012 |

OTHER PUBLICATIONS

European Search Report dated Feb. 25, 2014 in corresponding European patent application No. 13 19 5245.9.

* cited by examiner

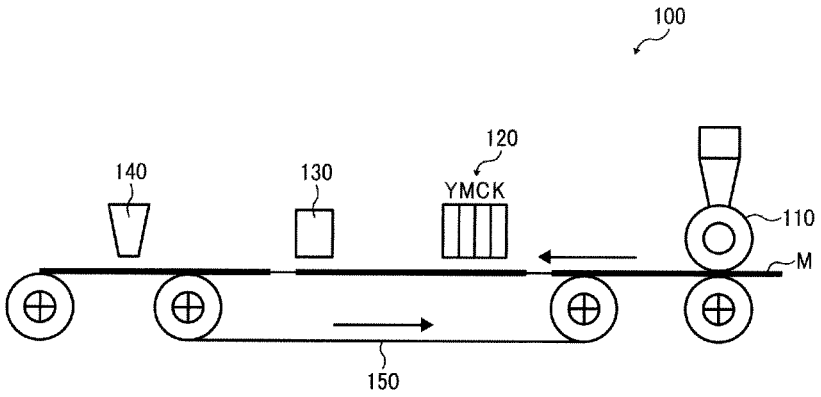
100
120
YMCK
140
130
110
M
150

IMAGE FORMING METHOD AND IMAGE FORMING APPARATUS

CROSS-REFERENCE TO RELATED APPLICATIONS

This patent application is based on and claims priority pursuant to 35 U.S.C. §119 to Japanese Patent Application No. 2013-000604, filed on Jan. 7, 2013, in the Japan Patent Office, the entire disclosure of which is hereby incorporated by reference herein.

BACKGROUND

1. Technical Field

The present invention relates to an image forming method and an image forming apparatus.

2. Description of the Related Art

An image forming method of discharging an aqueous pigment ink on the surface of a recording medium followed by applying an after-treatment liquid is known.

Recently, the inkjet recording has been required to form images like conventional offset printing images on coated papers for commercial printing.

However, since the coated papers for commercial printing are difficult to absorb water, images having good antifriction cannot be formed.

Japanese published unexamined application No. JP-2010-115854-A discloses a method of printing images applying a color ink, a resin ink and a reaction ink by an inkjet recording method using an aqueous ink set on a recording medium having no or low ink absorbability. The aqueous ink set includes a color ink including a colorant, a resin ink including resin particles without a colorant, and a reaction ink including a reactant aggregating structural components of the color ink and the resin ink. The color ink includes a water-insoluble colorant, a water-soluble or -insoluble resin, a water-soluble solvent and a surfactant. The resin ink includes a water-soluble resin solvent and thermoplastic resin particles insoluble in water but compatible with the water-soluble resin solvent, and the content of the resin particles in the resin ink is not less than the content of the colorant in the color ink. The reaction ink includes a reactant selected from multivalent metallic salts, and polyarylamine and its derivatives; and a surfactant. Further, the method includes a drying process during and/or after printing.

However, the method is unable to form images having good fixability and anti-blocking on the coated papers for commercial printing.

Because of these reasons, a need exists for an image forming method and an image forming apparatus capable of forming images having good fixability and anti-blocking on the coated papers for commercial printing.

SUMMARY

Accordingly, one object of the present invention is to provide an image forming method capable of forming images having good fixability and anti-blocking on the coated papers for commercial printing.

Another object of the present invention is to provide an image forming apparatus capable of forming images having good fixability and anti-blocking on the coated papers for commercial printing.

These objects and other objects of the present invention, either individually or collectively, have been satisfied by the discovery of an image forming method, including discharging an inkjet ink including a water-dispersible colorant, a wetter, a surfactant, a penetrant and water on a surface of a recording medium; and applying an after-treatment liquid including a water-dispersible polyurethane resin having a median diameter of from 0.01 to 0.10 μm, water and at least one of a polyethylene wax and a paraffin wax on the surface of the recording medium on which the inkjet ink is discharged.

In another aspect, the present invention provides an image forming apparatus, including a discharger to discharge an inkjet ink including a water-dispersible colorant, a wetter, a surfactant, a penetrant and water on a surface of a recording medium; and an applicator to apply an after-treatment liquid including a water-dispersible polyurethane resin having a median diameter of from 0.01 to 0.10 μm, water and at least one of a polyethylene wax and a paraffin wax on the surface of the recording medium on which the inkjet ink is discharged.

These and other objects, features and advantages of the present invention will become apparent upon consideration of the following description of the preferred embodiments of the present invention taken in conjunction with the accompanying drawings.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

FIGURE is a schematic view illustrating an embodiment of the image forming apparatus of the present invention.

DETAILED DESCRIPTION

The present invention provides an image forming method capable of forming images having good fixability and anti-blocking on the coated papers for commercial printing.

In another aspect, the present invention provides an image forming apparatus capable of forming images having good fixability and anti-blocking on the coated papers for commercial printing.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIGURE is a schematic view illustrating an embodiment of the image forming apparatus of the present invention.

An image forming apparatus 100 includes a pre-treatment liquid applicator 110, an ink discharger 120, an after-treatment liquid discharger 130, a drier 140 and a transferer 150.

The pre-treatment liquid applicator 110 applies a pre-treatment liquid to a recording medium M.

Methods of coating the pre-treatment liquid are not particularly limited, but include inkjet methods, blade coat methods, gravure coat methods, gravure offset coat methods, bar coat methods, roll coat methods, knife coat methods, air knife coat methods, comma coat methods, U-comma coat methods, AKKU coat methods, smoothing coat methods, micro gravure coat methods, reverse roll coat methods, 4 or 5-roll coat methods, curtain coat methods, slide coat methods, die coat methods, etc.

The pre-treatment liquid applicator 110 may be omitted.

When a coated paper for commercial printing is used as the recording medium M, an image without application of the pre-treatment liquid, multi feed occasionally occurs in a later process. The application of the pre-treatment liquid prevents the multi feed without deterioration of anti-blocking.

The ink discharger 120 discharges an inkjet ink on the surface of the recording medium M on which the pre-treatment liquid is applied.

Known inkjet heads can be used as the ink discharger 120.

The after-treatment liquid discharger 130 discharges an after-treatment liquid on an area of the surface of the recording medium M on which the inkjet ink is applied.

Known inkjet heads can be used as the after-treatment liquid discharger 130.

Instead of the after-treatment liquid discharger 130, an after-treatment liquid applicator applying the after-treatment liquid on almost all area of the surface of the recording medium M on which the inkjet ink is applied may be formed.

Methods of coating the after-treatment liquid are not particularly limited, but include inkjet methods, blade coat methods, gravure coat methods, gravure offset coat methods, bar coat methods, roll coat methods, knife coat methods, air knife coat methods, comma coat methods, U-comma coat methods, AKKU coat methods, smoothing coat methods, micro gravure coat methods, reverse roll coat methods, 4 or 5-roll coat methods, curtain coat methods, slide coat methods, die coat methods, etc.

The drier 140 dries the recording medium M on which after-treatment liquid is applied with hot air.

The drier 140 may heat and dry the recording medium M on which after-treatment liquid is applied with infrared light, a microwave, a roll heater, etc. instead of hot air. Further, the recording medium M may naturally be dried.

The transferer 150 transfers the recording medium M.

The transferer 150 is not particularly limited, provided it can transfer the recording medium M, and includes a transfer belt, etc.

The image forming apparatus 100 may further include a fixer fixing an image formed on the recording medium M thereon with heat.

The fixer is not particularly limited, and includes a fixing roller, etc.

The fixer typically fixes an image formed on the recording medium M with heat at from 50 to 150° C., and preferably from 100 to 150° C.

The inkjet ink includes a water-dispersible colorant, a wetter, a surfactant, a penetrant and water, and may further include a water-dispersible resin, a pH adjuster, an antiseptic/antifungal agent, an antirust agent, etc.

The inkjet ink typically includes the water-dispersible colorant in an amount of from 6 to 15% by weight, and preferably from 8 to 12% by weight. When less than 6% by weight, the ink deteriorates in colorability, resulting in low image density. When greater than 15% by weight, the ink does not expand dot, resulting in low image density.

The water-dispersible colorant is not particularly limited, and includes resin-coated pigments, self-dispersion pigments, etc., which may be used in combination. Among these, the resin-coated pigments are preferably used.

Pigments included in the water-dispersible colorant are not particularly limited, and include organic pigments such as azo pigments, phthalocyanine pigments, anthraquinone pigments, quinacridone pigments, dioxazine pigments, indigo pigments, thio indigo pigments, perylene pigments, isoindolinone pigments, aniline black, azomethine pigments, Rhodamine B Lake pigments and carbon black; and inorganic pigments such as iron oxide, titanium oxide, calcium carbonate, barium sulfate, aluminum hydroxide, barium yellow, iron blue, cadmium red, chrome yellow and metallic powders, which may be used in combination.

Marketed products of the carbon black include No. 2300, No. 900, MCF88, No. 40, No. 52, MA7, MA8 and 2200B from Mitsubishi Chemical Corp.; RAVEN 1255 from Columbian Chemicals; REGAL 400R, REGAL 660R and MOGUL L from Cabot Corp.; and Color Black FW1, Color Black FW18, Color Black S170, Color Black S150, Printex 35 and Printex U from Ebonik-Degussa GmbH, etc.

The water-dispersible resin is uniformly dispersed in water and typically present in a dispersion or an emulsion.

The water-dispersible resin is not particularly limited, and includes condensed synthetic resins such as polyester resins, polyurethane resins, epoxy resins, polyamide resins, polyether resins, (meth)acrylic resins, acrylic-silicone resins and fluorine-containing resins; additional synthetic resins such as polyolefin, polystyrene resins, polyvinylalcohol resins, polyvinyl ester resins, polyacrylic resins and unsaturated carboxylic resins; and natural polymers such as celluloses, rosins and natural rubbers, which may be used in combination. Among these, polyurethane is preferably used.

The inkjet ink typically includes the wetter in an amount of from 10 to 50% by weight, and preferably from 20 to 35% by weight. When less than 10% by weight, a nozzle of an inkjet head dries quickly, resulting in deterioration of discharge stability. When greater than 50% by weight, the inkjet ink increases in viscosity, resulting in deterioration of discharge stability.

Specific examples of the wetter include, but are not limited to, polyols such as ethylene glycol, diethylene glycol, triethylene glycol, tetraethylene glycol, polyethylene glycol, propylene glycol, 1,3-butane diol, 1,3-propane diol, 2-methyl-1,3-propanediol, 1,4-butanediol, 1,5-pentanediol, 1,6-hexane diol, glycerin, 1,2,6-hexanetriol, 2-ethyl-3-hexanediol, 1,2,4-butantriol, 1,2,3-butanetriol and petriol; polyol alkyl ethers such as ethylene glycol monoethyl ether, ethylene glycol monobutyl ether, diethylene glycol monomethyl ether, diethylene glycol monoethyl ether, diethylene glycol monobutyl ether, triethylene glycol monobutyl ether, tetraethylene glycol monomethyl ether and propylene glycol monoethyl ether, nitrogen-containing heterocyclic compounds such as N-methyl-2-pyrrolidone, N-hydroxyethyl-2-pyrrolidone, 2-pyrrolidone, 1,3-dimethyl imidazolidinone and ε-caprolactam; amides such as formamide, N-methyl formamide, N,N-dimethyl formamide; amines such as monoethanol amine, diethanol amine, triethanol amine, monoethyl amine, diethyl amine and triethyl amine; sulfur-containing compounds such as dimethyl sulfoxide, sulfolane, thiodiethanol; propylene carbonate; ethylene carbonate; γ-butyrolactone, which can be used in combination.

The inkjet ink typically includes the penetrant in an amount of from 0.1 to 20% by weight, and preferably from 5 to 10% by weight. When less than 0.1% by weight, color bleed may occur. When greater than 20% by weight, discharge stability and image density may deteriorate.

Specific examples of the penetrant include, but are not limited to, alkyl or allyl ethers of polyhols such as diethyleneglycol monophenylether, ethyleneglycol monophenylether, ethyleneglycol monoallylether, diethyleneglycol monophenyether, diethyleneglycol monobutylether, propyleneglycol monobutylether and tetraethyleneglycol chlorophenylether; and lower alcohols such as ethanol and 2-propanol, which can be used in combination.

The inkjet ink typically includes the surfactant in an amount of from 0.01 to 3% by weight, and preferably from 0.5 to 2% by weight. When less than 0.01% by weight, leveling ability may deteriorate. When greater than 3% by weight, image density may deteriorate.

The surfactant is not particularly limited, provided it can improve leveling ability, and includes fluorine-containing surfactants, silicone surfactants, anionic surfactants, nonionic surfactants, etc., which can be used in combination. Among these, the fluorine-containing surfactants and the silicone surfactants are preferably used.

The number of carbon atoms substituted with a fluoro group is typically 2 to 16, and preferably 4 to 16. When less than 2, the leveling ability may deteriorate. When greater than 16, the discharge stability may deteriorate.

Specific examples of fluorine-containing anionic surfactants include perfluoroalkyl sulfonic acid, perfluoroalkyl sulfonate salts, perfluoroalkyl carboxylic acid, perfluoroalkyl carboxylate salts, perfluoroalkyl phosphate ester salts, sulfate ester salts of polyoxyalkylene ether polymer having a perfluoroalkyl ester group in the side chains, etc Specific examples of counterions of salts of fluorine-containing anionic surfactants include, but are not limited to, a lithium ion, a sodium ion, an ammonium ion, a monoethanol ammonium ion, a diethanol ammonium ion and a triethanol ammonium ion.

The fluorine-containing anionic surfactant is preferably a compound having the following formulae:

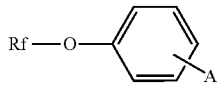

wherein $R_f$ represents a group having the following formula (A) or (B):

(A)

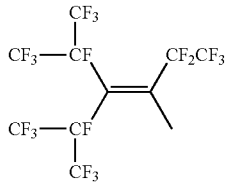

(B)

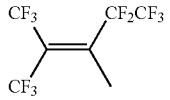

A is a compound having the following formula:

$$—SO_3^-M^+,\ —COO^-M^+ \text{ or } —PO_3^-M^+$$

wherein $M^+$ represents a proton, a lithium ion, a sodium ion, an ammonium ion, a monoethanol ammonium ion, a diethanol ammonium ion or a triethanol ammonium ion;

$$(R_f'O)_nPO(O^-M^+)_m$$

wherein Rf' represents a group having the following formula (C):

$$F(CF_2CF_2)_nCH_2CH_2— \quad (C)$$

wherein n is an integer of from 3 to 10, and $M^+$ represents a proton, a lithium ion, a sodium ion, an ammonium ion, a monoethanol ammonium ion, a diethanol ammonium ion or a triethanol ammonium ion; n is 1 or 2; and m is 2−n;

$$R_f'SCH_2CH_2COO^-M^+$$

wherein Rf' represents a group having the formula (C); and $M^+$ represents a proton, a lithium ion, a sodium ion, an ammonium ion, a monoethanol ammonium ion, a diethanol ammonium ion or a triethanol ammonium ion; or $$R_f'SO_3^-M^+$$

wherein Rf' represents a group having the formula (C); and $M^+$ represents a proton, a lithium ion, a sodium ion, an ammonium ion, a monoethanol ammonium ion, a diethanol ammonium ion or a triethanol ammonium ion.

Specific examples of the fluorine-containing nonionic surfactants include perfluoroalkyl phosphate ester, adducts of perfluoroalkyl ethyleneoxide adducts, polyoxyalkylene ether having a perfluoroalkyl oxy group in their side chains. Among these, the polyoxyalkylene ether having a perfluoroalkyl oxy group in their side chains is preferably used because of lower foaming property.

The fluorine-containing nonionic surfactant is preferably a compound having the following formulae:

$$CF_3CF_2(CF_2CF_2)_mCH_2CH_2O(CH_2CH_2O)_nH$$

wherein m is an integer of from 0 to 10; n is an integer of from 0 to 40; and m and n are not 0 at the same time;

$$R_fO(CH_2CH_2O)_nH$$

wherein $R_f$ represents a group having the formula (A) or (B); and n is an integer of from 5 to 20; or $$R_f'O(CH_2CH_2O)_nH$$

wherein Rf' represents a group having the formula (C); and n is an integer of from 1 to 40.

Fluorine-containing ampholytic surfactant is preferably a compound having the following formula:

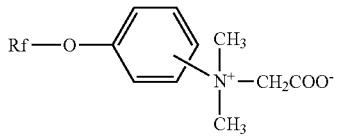

wherein Rf represents a group having the formula (A) or (B).

Oligomeric fluorine-containing surfactant is preferably a compound having the following formulae:

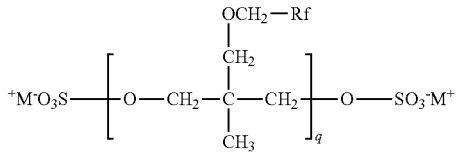

wherein Rf represents a group having the following formula:

$$F(CF_2CF_2)_nCH_2—$$

wherein n is an integer of from 1 to 4; $M^+$ represents a proton, a lithium ion, a sodium ion, an ammonium ion, a monoethanol ammonium ion, a diethanol ammonium ion or a triethanol ammonium ion; and q is an integer of from 1 to 6; or

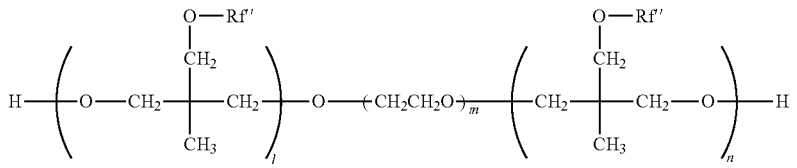

wherein Rf'' represents a perfluoroalkyl group having 2 to 22 carbon atoms; m is an integer of from 6 to 25; each of 1 and n is independently an integer of from 0 to 10; and 1 and n are not 0 at the same time.

Specific examples of marketed products of the fluorine-containing surfactants include Surflon S-111, S-112, S-113, S-121, S-131, S-132, S-141 and S-145 (from Asahi Glass Co., Ltd.); Fullard FC-93, FC-95, FC-98, FC-129, FC-135, FC-170C, FC-430, FC-431 (from Sumitomo 3M Ltd.); Megafac F-470, F1405, F-474 (from Dainippon Ink And Chemicals, Inc.); Zonyl TBS, FSP, FSA, FSN-100, FSN, FSO-100, FSO, FS-300, UR (from DuPont); FT-110, FT-250, FT-251, FT-400S, FT-150, FT-400SW (from Neos Co.); PF-136A, PF-156A, PF151N, PF-154. PF-159 (from Omnova Inc.); Unidine DSN-403N (from Daikin Industries, Ltd.), etc.

The silicone surfactants are not particularly limited, and include polydimethylsiloxane with modified side chains, polydimethylsiloxane with modified both ends, polydimethylsiloxane with modified one end, and polydimethylsiloxane with modified side chains and both ends. Among these, a polyether-modified silicone surfactant having a polyoxyethylene group or polyoxyethylene polyoxypropylene group is preferably used.

The polyether-modified silicone surfactant is preferably a compound having the following formula:

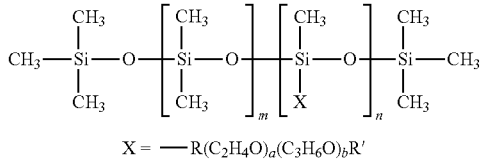

$$X = -R(C_2H_4O)_a(C_3H_6O)_bR'$$

wherein R represents an alkylene group; R' represents an alkyl group; and m, n, a and b are independently an integer.

Specific examples of marketed products of the polyether-modified fluorine-containing surfactants include KF-618, KF-642 and KF-643 (from Shin-Etsu Chemical Co.); EMALEX-SS-5602 and SS-1906EX (from Nippon Emulsion Co. Ltd.); FZ-2105, FZ-2118, FZ-2154, FZ-2161, FZ-2162, FZ-2163 and FZ-2164 (from Dow Corning Toray Silicone Co., Ltd.); BYK-33 and BYK-387 (from BYK Chemie GmbH); TSF44440m TSF4452 and TSF4453 (from Toshiba Silicones Co., Ltd.), etc.

The anionic surfactants are not particularly limited, and include polyoxyethylene alkylether acetate salts, dodecyl benzene sulfonate salts, succinate ester sulfonate salts, lauryl acid salts, and salts of polyoxyethylene alkylether sulfate, etc.

The nonionic surfactants are not particularly limited, and include polyoxyethylene alkyl ethers, polyoxyethylene propylene polyoxyethylene alkyl ethers, polyoxyethylene alkyl esters, polyoxyethylene sorbitan fatty acid esters, polyoxyethylene alkylphenyl ethers, polyoxyethylene alkyl amine, polyoxyethylene alkylamide, etc.

The inkjet ink typically includes the pH adjuster in an amount of from 0.01 to 3.0% by weight, and preferably from 0.5 to 2% by weight.

The pH adjusters are not particularly limited, and include alkali metal hydroxides such as lithium hydroxide, sodium hydroxide and potassium hydroxide; ammonium hydroxides; quaternary ammonium hydroxides; quaternary phosphonium hydroxides; alkali metal carbonates such as lithium carbonate, sodium carbonate and potassium carbonate; amines such as diethanol amine and triethanol amine; boronic acid; hydrochloric acid; nitric acid; sulfuric acid; acetic acid, etc., which may be used in combination.

The inkjet ink typically includes the antiseptic/antifungal agent in an amount of from 0.01 to 3.0% by weight, and preferably from 0.5 to 2% by weight.

The antiseptic/antifungal agents are not particularly limited, and include benzotriazole, sodium dehydroacetate, sodium sorbate, sodium 2-pyridinethiol-1-oxide, sodium benzoate, sodium pentachlorophenol, etc., which may be used in combination.

The inkjet ink typically includes the antirust agent in an amount of from 0.01 to 3.0% by weight, and preferably from 0.5 to 2% by weight.

The antirust agents are not particularly limited, and include acidic sulfite salts, sodium thiosulfate, thiodiglycolic acid ammonium, diisopropyl ammonium nitrate, pentaerythritol tetranitrate, dicyclohexyl ammonium nitrate, etc., which may be used in combination.

The pre-treatment liquid includes amines, and may further include water, multivalent metallic salts, ammonium salts, acids, etc.

The amines are not particularly limited, provided they are soluble in water, and include dimethylamine, diethylamine, dipropylamine, methyl ethylamine, methyl propylamine, methyl butylamine, methyl octylamine, methyl laurelamine, ethylene diamine, diethylene triamine, polyallylamine, polyethylene imine, piperidine, pyrrol, carbazole, etc., which may be used in combination.

The pre-treatment liquid typically includes the multivalent metallic salts in an amount of from 0.1 to 40% by weight, preferably from 1 to 30% by weight, and more preferably from 3 to 15% by weight. When less than 0.1% by weight, the water-dispersible colorant may be difficult to aggregate. When greater than 40% by weight, the water-dispersible colorant may aggregate near a nozzle of the inkjet head.

The multivalent metallic salt is formed of a di- or more valent metallic ion and a counterion, and soluble in water.

The di- or more valent metallic ions are not particularly limited, and include $Ca^{2+}$, $Cu^{2+}$, $Ni^{2+}$, $Mg^{2+}$, $Zn^{2+}$, $Ba^{2+}$, etc., which may be used in combination.

The counterions are not particularly limited, and include $Cl^-$, $NO_3^-$, $I^-$, $Br^-$, $ClO_3^-$, acetate ion, formate on, oxalate ion, lactate ion, citrate ion, maleate ion, malonate ion, etc., which may be used in combination.

The ammonium salt is formed of an ammonium ion and a counterion, and soluble in water.

The counterions are not particularly limited, and include $Cl^-$, $NO_3^-$, $I^-$, $Br^-$, $ClO_3^-$, acetate ion, formate on, oxalate ion, lactate ion, citrate ion, maleate ion, malonate ion, etc., which may be used in combination.

The acids are not particularly limited, provided they are soluble in water, and include inorganic acids such as hydrochloric acid, sulfuric acid, sulfurous acid, nitric acid, nitrous acid, phosphoric acid, boronic acid and carbonic acid; and organic acids such as acetic acid, formic acid, oxalic acid, lactic acid, citric acid, maleic acid, malonic acid etc., which may be used in combination. Among these, acids having a primary dissociation constant pKa not greater than 5 are preferably used.

It is preferable that the pre-treatment liquid further includes a water-dispersible polyurethane resin, polyethylene wax and/or a paraffin wax as the after-treatment liquid mentioned later does.

The water-dispersible polyurethane resin has a median diameter of from 0.01 to 0.10 μm, and preferably from 0.02 to 0.09 μm. When less than 0.01 μm or greater than 0.10 μm, the resultant image deteriorates in anti-blocking.

The median diameter of the water-dispersible polyurethane resin can be measured by a particle diameter distribution measurer Nanotrac UPA-EX150 (from Nikkiso Co., Ltd.).

It is preferable that the pre-treatment liquid further includes polyether-modified polydimethyl siloxane as the after-treatment liquid mentioned later does.

The pre-treatment liquid may further include a wetter, a surfactant, a pH adjuster, an antiseptic/antifungal agent, an antirust agent, etc. as the inkjet ink does.

The after-treatment liquid includes a water-dispersible polyurethane resin, water, polyethylene wax and/or a paraffin wax.

The after-treatment liquid typically includes the water-dispersible polyurethane resin in an amount not less than 3% by weight, and preferably not less than 5% by weight. When less than 3% by weight, the resultant image may deteriorate in anti-blocking. When greater than 10% by weight, the resultant image may deteriorate in fixability and anti-blocking.

The water-dispersible polyurethane resin has a median diameter of from 0.01 to 0.10 μm, and preferably from 0.02 to 0.09 μm. When less than 0.01 μm or greater than 0.10 μm, the resultant image deteriorates in anti-blocking.

The water-dispersible polyurethane resins are not particularly limited, and include acryl-modified urethane resins, carbonate-modified urethane resins, which may be used in combination.

Specific examples of marketed products of the acryl-modified urethane resins include SU-100 and SU-100N (from CSC Co., Ltd.), etc.

Specific examples of marketed products of the carbonate-modified urethane resins include Bayhydrol UH XP 2648/1 (from Sumitomo Bayer Urethane Co., Ltd.).

Methods of preparing the water-dispersible polyurethane resins are not particularly limited, and include a method disclosed in Japanese Patent No. JP-3661047-B1 (Japanese published unexamined application No. JP-11-140149-A), etc.

The after-treatment liquid typically includes the polyethylene wax and/or a paraffin wax in an amount of from 1 to 7% by weight, preferably from 1 to 5% by weight, and more preferably from 1 to 3% by weight. When less than 1% by weight, the resultant image may deteriorate in fixability and anti-blocking. When greater less than 7% by weight, the resultant image may deteriorate in anti-blocking.

Specific examples of marketed products of the polyethylene wax include AQUACER-513 and AQUACER-515 (from BYK Chemie GmbH), Poriron P-502 (from CHUKYO YUSHI CO., LTD.), etc.

Specific examples of marketed products of the paraffin wax include AQUACER-498 (from BYK Chemie GmbH), etc.

Specific examples of marketed products of mixed wax of the polyethylene wax and the paraffin wax include AQUACER-539 (from BYK Chemie GmbH), etc.

A weight ratio of the water-dispersible polyurethane resin to the polyethylene wax in the after-treatment liquid is typically from 1 to 10, and preferably from 1 to 7 when the after-treatment liquid includes the polyethylene wax. When less than 1, the resultant image may deteriorate in anti-blocking. When greater than 10, the resultant image may deteriorate in fixability and anti-blocking.

A weight ratio of the paraffin wax to the polyethylene wax in the after-treatment liquid is typically from 1 to 9, and preferably from 1 to 7 when the after-treatment liquid includes the polyethylene wax and the paraffin wax It is preferable that the after-treatment liquid further includes polyether-modified polydimethylsiloxane.

The after-treatment liquid typically includes the polyether-modified polydimethylsiloxane in an amount of from 0.1 to 5% by weight, preferably from 0.5 to 3% by weight, and more preferably from 1 to 1.5% by weight. When less than 0.1% by weight, the resultant image may deteriorate in anti-blocking. When greater than 5% by weight, the resultant image may deteriorate in fixability.

Specific examples of marketed products of the polyether-modified polydimethylsiloxane include BYK-333 and BYK-UV3500 (from BYK Chemie GmbH), etc.

The after-treatment liquid may further include water-dispersible resins other than the water-dispersible polyurethane resins.

The water-dispersible resins other than the water-dispersible polyurethane resins are not particularly limited, and include condensed synthetic resins such as polyester resins, epoxy resins, polyamide resins, polyether, (meth)acrylic resins, acryl-silicone resins and fluorine-containing resins; additional synthetic resins such as polyolefin resins, polystyrene resins, polyvinylalcohol resins, polyvinyl ester resins, polyacrylic resins and unsaturated carboxylic resins; and natural polymers such as celluloses, rosins and natural robbers, etc., which may be used in combination. Among these, polystyrene resins and polyacrylic resins are preferably used.

The after-treatment liquid may further include a wetter, a surfactant, a pH adjuster, an antiseptic/antifungal agent, an antirust agent, etc. as the inkjet ink does.

The recording media are not particularly limited, and include plain papers, glossy papers, special papers, cloth, films, OHP sheets, coated papers for commercial printing, etc. Among these, the coated papers for commercial printing are preferably used because images having good fixability and anti-blocking can be formed thereon.

Specific examples of marketed products of the coated papers for commercial printing include Ricoh Business Coat Gloss 100 from Ricoh Company, Ltd; OK Top Cost+, OK Kanefuji+and SA Kanefuji+from Oji Paper Co., Ltd.; Super MI dull and Aurora Coat from Nippon Paper Industries Co., Ltd.; α Mat and μ Coat from Hokuetsu Paper Mills, Ltd.; Raicho Art and Raicho Super Art from Chuetsu Pulp & Paper Co., Ltd.; Pearl Coat N from Mitsubishi Paper Mills Limited, etc.

A coated layer is formed on one side or both sides of a substrate of the coated paper for commercial printing. The inkjet ink, the pre-treatment liquid and the after-treatment liquid is discharged or applied to the surface the coated layer is formed on.

Pure water transfers to the surface of the coated paper for commercial printing the coated layer is formed on in an amount of form 1 to 10 $mL/m^2$ when contacting thereto for 100 ms. When less than 1 $mL/m^2$, beading or color bleed may occur. When greater than 10 $mL/m^2$, image density may lower.

The amount of pure water transferred to the surface of the coated paper for commercial printing the coated layer is formed on can be measured by a dynamic scanning liquid absorbing meter K350 series D-type from KYOWA CO., LTD. The amount of pure water transferred when contacting thereto for 100 ms is interpolated from the amount thereof transferred when contacting thereto for around 100 ms.

The substrates are not particularly limited, and include papers mainly formed of wood fibers and sheet-shaped material such as nonwoven fabrics mainly formed of wood fibers and synthetic fibers.

The wood fibers are not particularly limited, and include wood pulp, waste paper pulp, etc.

The wood pulp includes broad-leaved tree bleached kraft pulp (LBKP), needle-leaved tree bleached kraft pulp (NBKP), NBSP, LBSP, GP, TMP, etc.

Materials of the waste paper pulp include materials shown in wastepaper standard quality specification list of Paper Recycling Promotion Center such as cards, Kent papers, white art papers, news papers, magazines, etc. Specific examples thereof include printer papers such as information concerned non-coated computer papers, heat-sensitive papers and pressure-sensitive papers, OA waster papers such as PPC papers; coated papers such as art papers, coated papers and mat papers; and waste papers of papers and paper boards of non-coated papers of chemical pulp papers and papers including a pulp having high yield rate such as high-quality papers, notes, writing papers, wrapping papers, fancy papers, middle-quality papers, news papers, super wrapping papers, pure-white roll papers and milk cartons, which may be used in combination.

The waste pulp paper is typically produced by combination of the following four processes:

(1) fiberizing the waste paper with a mechanical force and chemicals by a pulper and separating inks printed on the resultant fiber with a surfactant;

(2) removing foreign particles and dusts such as plastic include in the waste paper by a screen or a cleaner;

(3) excluding the ink separated form the fiber with a surfactant by a flotation method or a washing method; and (4) increasing whiteness by oxidizing or reducing.

A mixing ratio of the waste paper pulp in all pulp when mixed therein is preferably 40% or less in consideration of preventing curl.

Inner fillers used in the substrate are not particularly limited, and include white inorganic pigments such as light calcium carbonates, heavy calcium carbonates, kaolin, clay, talc, calcium sulfate, barium sulfate, titanium dioxide, zinc oxide, zinc sulfate, zinc carbonate, satin white, aluminum silicate, diatom earth, calcium silicate, magnesium silicate, synthetic silica, aluminum hydroxide, alumina, lithopone, zeolite, magnesium carbonate and magnesium hydroxide; and organic pigments such as styrene plastic pigments; acrylic plastic pigments, polyethylene, microcapsule, urea resins and melamine resins, etc., which may be used in combination.

Internal sizers used in producing the substrate are not particularly limited, and include neutral rosin sizers used in making neutral papers, alkenyl succinic anhydride (ASA), alkyl ketene dimer (AKD), petroleum resin sizers, etc. Among these, the neutral rosin sizers and the alkenyl succinic anhydride preferably used.

The substrate typically has a thickness of from 50 to 300 μm.

The substrate typically has a weight of from 45 to 290 $g/m^2$.

The coated layer includes a pigment and a binder.

An inorganic pigment or a mixture of the inorganic pigment and an organic pigment is used as the pigment.

Specific examples of the inorganic pigment include, but are not limited to kaolin, talc, heavy calcium carbonates, light calcium carbonates, calcium sulfite, amorphous silica, titanium white, magnesium carbonate, titanium dioxide, aluminum hydroxide, calcium hydroxide, magnesium hydroxide, zinc hydroxide and chlorite. Among these, kaolin is preferably used because the resultant image has good glossiness and closeness to offset printing.

Kaolins include delaminated kaolin, calcined kaolin, surface-treated engineered kaolin, etc.

The coated layer preferably includes a kaolin including particles having a diameter of 2 μm or less in an amount of 80% by weight or more in an amount of 50% by weight or more.

A weight ratio of the kaolin to the binder is typically not less than 0.5. When less than 0.5, the coated layer may deteriorate in glossiness. A weight ratio of the kaolin to the binder is preferably not greater than 0.9 in consideration of fluidity, particularly viscosity of the kaolin when applied with high shearing force in terms of coating suitability.

The organic pigment can form a bulky and glossy coated layer having good surface coatability because of having good gloss-imparting ability and a specific gravity lower than that of an inorganic pigment.

The organic pigments are not particularly limited, and include particulate styrene-acrylic copolymers, particulate styrene-butadiene copolymers, particulate polystyrene, particulate polyethylene, etc., which may be used in combination.

A weight ratio of the organic pigment to a total weight of the inorganic pigment and the organic pigment is typically from 0.02 to 0.2. When less than 0.02, the effect of the organic pigment may not be exerted. When greater than 0.2, the coating liquid lowers in fluidity and coatability, resulting in increase in cost.

The organic pigment has the shape of a block, a hollow and a doughnut.

The organic pigment has a volume-average particle diameter of from 0.2 to 3.0 μm in consideration of a balance among gloss-imparting ability, surface coatability and fluidity of the coating liquid.

The organic pigment having the shape of a hollow typically has a porosity not less than 40%.

The binders are not particularly limited, and include aqueous resins such as water-soluble resins and water-dispersible resins.

The water-soluble resins are not particularly limited, and include modified polyvinylalcohols such as polyvinylalcohol, anion-modified polyvinylalcohol, cation-modified polyvinylalcohol and acetal-modified polyvinylalcohol; polyurethane; modified polyvinyl pyrrolidones such as polyvinyl pyrrolidone, copolymers of polyvinyl pyrrolidone and vinylacetate, copolymers of vinylpyrrolidone and dimethylaminoethyl methacrylate, copolymers of quaternary vinylpyrrolidone and dimethylaminoethyl methacrylate and copolymers of vinylpyrrolidone and methacrylamide propyl trimethyl ammonium chloride; celluloses such as carboxymethylcellulose, hydroxyethylcellulose and hydroxypropylcellulose: modified celluloses such as cationized hydroxyethylcellulose; synthetic resins such as polyester, polyacrylate (ester), melamine resins or their modified resins and copolymers of polyester and polyurethane; poly(meth)acrylate; poly (meth)acrylamide; oxidized starch; phosphorylated starch; self-denatured starch; cationized starch or other modified starches; polyethylene oxide; sodium polyacrylate; sodium alginate, etc., which may be used in combination. Among these, polyvinylalcohol, cation-modified polyvinylalcohol, acetal-modified polyvinylalcohol, polyester, polyurethane and copolymers of polyester and polyurethane are preferably used.

The water-dispersible resins are not particularly limited, and include polyvinylacetate, ethylene-vinylacetate copolymers, polystyrene, styrene(meth)acrylate ester copolymers, (meth)acrylate ester copolymers, vinylacetate-(meth)acrylate (ester) copolymers, styrene-butadiene copolymers, ethylene-propylene copolymers, polyvinylether, silicone-acrylic copolymers, etc., which may be used in combination.

The water-dispersible resins may include crosslinkers such as methylolated melamine, methylolated urea, methylolated hydroxy propylene urea and isocyanate, and may be a self-crosslinkable copolymer having a structural unit originating from N-methylolacrylamide, etc.

The coated layer may further include a surfactant. This improves water resistance of images and increases image density, and improves bleeding.

The surfactants are not particularly limited, and include anionic surfactants, cationic surfactant, ampholytic surfactants and nonionic surfactants. Among these, the nonionic surfactants are preferably used.

Specific examples of the nonionic surfactants include higher alcohol ethylene oxide adducts, alkyl phenol ethylene oxide adducts, aliphatic acid ethylene oxide adducts, polyol fatty acid ester ethylene oxide adducts, higher aliphatic amine ethylene oxide adducts, aliphatic amide ethylene oxide adducts, oil and fat ethylene oxide adducts, polypropylene glycol ethylene oxide adducts, fatty acid esters of glycerol, fatty acid esters of pentaerythritol, fatty acid esters of sorbitol and sorbitan, fatty acid esters of sucrose, alkyl ethers of polyols, fatty acid amides of alkanol amines, etc., which may be used in combination.

The polyols are not particularly limited, and include glycerol, trimethylol propane, pentaerythritol, sorbitol, sucrose, etc.

The ethylene oxide adducts may include alkylene oxides such as propylene oxide and butylene oxide together with the ethylene oxide.

The alkylene oxides typically include the ethylene oxide in an amount not less than 50% by mol.

The nonionic surfactant typically has an HLB value of from 4 to 15, and preferably from 7 to 13.

The coated layer may further include an alumina powder, a pH adjuster, an antiseptic agent and an antioxidant.

The coated lay is formed by impregnating a coating liquid in the substrate or coating the coating liquid thereon.

Coaters used in forming the coated layer are not particularly limited, and include conventional size presses, gate roll size presses, film transfer size presses, blade coaters, rod coaters, air knife coaters, curtain coaters, etc.

The coated layers may be formed by the conventional size presses, gate roll size presses or film transfer size presses installed in paper machines.

Solid contents of the coated layer are typically from 0.5 to 20 g/m$^2$, and preferably from 1 to 15 g/m$^2$.

The coating liquid may be dried after impregnated in the substrate or coated thereon.

The coating liquid is typically dried at from 100 to 250° C. after impregnated in the substrate or coated thereon.

A back layer may be formed on a surface of the substrate of the coated paper for commercial printing, on which a coated layer is not formed. Other layers may be formed between the substrate and the coated layer or the back layer. Further, a protection layer may be formed on the coated layer. The other layers may be single or plural.

A static friction coefficient and a dynamic friction coefficient when surfaces the after-treatment liquid is coated on each thereof are frictionized with each other are from 0.1 to 0.7 and 0.1 to 0.4, respectively. A static friction coefficient and a dynamic friction coefficient when a surface the after-treatment liquid is coated on and a surface only the coated layer is coated on without the after-treatment liquid are frictionized with each other are from 0.1 to 0.7 and 0.1 to 0.4, respectively.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

(Preparation of Self-Dispersion Black Pigment Dispersion)

A carbon black MA600 from Mitsubishi Chemical Corp. (CTAB specific surface area: 150 m$^2$/g, DBP absorption number 100 ml/100 g) was added in an amount of 90 g to 3000 ml of 2.5 N sodium sulfonate solution, then the mixture was stirred at 300 rpm, 60° C. to react for 10 hours thereby to oxidize the carbon black. The reaction liquid was filtered, the separated carbon black was neutralized using a sodium hydroxide solution, which was then subjected to extracorporeal ultrafiltration. The resulting carbon black was rinsed with water, dried and dispersed into pure water in a solid content of 30% to prepare a self-dispersion black pigment dispersion.

The self-dispersion black pigment dispersion had a median diameter of 103 nm when measured by a particle diameter distribution measurer Nanotrac UPA-EX150 (from Nikkiso Co., Ltd.).

(Preparation of Resin-Coated Black Pigment Dispersion)

After the inside of a flask having a capacity of 1 L equipped with a mechanical stirrer, a thermometer, a nitrogen gas inlet tube, a recirculation tube and a dripping funnel is substituted with a nitrogen gas, 11.2 g of styrene, 2.8 g of acrylic acid, 12.0 g of laurylmethacrylate, 4.0 g of polyethyleneglycol methacrylate, 4.0 g of styrene macromer and 0.4 g of mercapto ethanol were mixed therein to prepare a mixture and the mixture was heated to have a temperature of 65° C. Next, a mixed liquid including 100.8 g of styrene, 25.2 g of acrylic acid, 108.0 g of laurylmethacrylate, 36.0 g of polyethyleneglycol methacrylate, 60.0 g of hydroxyethylmethacrylate, 36.0 g of styrene macromer, 3.6 g of mercapto ethanol, 2.4 g of azobismethylvaleronitrile and 18 g of methyl ethyl ketone was dripped in the flask for 2.5 hrs. Further, a mixed liquid including 0.8 g of azobismethylvaleronitrile and 18 g of methyl ethyl ketone was dripped in the flask for 0.5 hrs. Next, after the mixture was left for 1 hr at 65° C., 0.8 g of azobismethylvaleronitrile were added thereto and left for 1 hr. Further, 364 g of methyl ethyl ketone were added thereto to prepare 800 of a resin solution having a concentration of 50% by weight.

After 28 g of the resin solution, 42 g of carbon black FW100 from Ebonik-Degussa GmbH, 13.6 g of an aqueous solution of 1M potassium hydroxide, 20 g of methyl ethyl ketone and 13.6 g of ion-exchanged water were stirred to prepare a mixture, the mixture was kneaded to prepare a paste. Next, after the paste was placed in 200 g of pure water and stirred, methyl ethyl ketone and water were removed by an evaporator. Further, the resultant solution was filtered under pressure using a polyvinylidenefluoride membrane filter having an average aperture of 5.0 μm to prepare a resin-coated black pigment dispersion including a pigment in an amount of 15% by weight and a solid content of 20% by weight.

The resin-coated black pigment dispersion had a median diameter of 104 nm when measured by a particle diameter distribution measurer Nanotrac UPA-EX150 (from Nikkiso Co., Ltd.).

(Preparation of Resin-Coated Magenta Pigment Dispersion)

The procedure for preparation of the resin-coated black pigment dispersion was repeated except for replacing the carbon black with C.I. Pigment Red 122.

The resin-coated magenta pigment dispersion had a median diameter of 127 nm when measured by a particle diameter distribution measurer Nanotrac UPA-EX150 (from Nikkiso Co., Ltd.).

(Preparation of Pre-Treatment Liquid 1)

After 23.42 parts of N,N-diethylethanolamine, 15 parts of L-lactic acid, 5 parts of potassium lactate, 1 part of silicone surfactant KF643 (from Shin-Etsu Chemical Co.), 0.05 parts of antifungal agent Proxel GXL (from Arch Chemicals Japan, Inc.), 0.1 parts of antirust agent 1,2,3-benzotriazole and 55.43 parts of water were stirred for 1 hr to be mixed, the resultant solution was filtered under pressure using a polyvinylidenefluoride membrane filter having an average aperture of 5.0 μm to prepare a pre-treatment liquid 1.

(Preparation of Inkjet Ink 1)

Sixteen (16) parts of 3-methyl-1,3-butanediol and 16 parts of glycerin as wetters, 1 part of 2-ethyl-1,3-hexanediol and 1 part of 2,2,4-trimethyl-1,3-pentanediol as penetrants, 2.5 parts of fluorine-containing surfactant DSN-403N (from Daikin Industries, Ltd.), 0.05 parts of antifungal agent Proxel GXL (from Arch Chemicals Japan, Inc.) and 9.85 parts of water were stirred for 1 hr to be mixed. Next, 53.3 parts of the resin-coated black pigment dispersion, 0.1 pats of a defoamer AD-01 (from Nissin Chemical Industry Co., Ltd.) and a 0.2 parts of a pH adjuster 2-amino-2-ethyl-1,3-propanedol were added to the mixture, and the mixture was stirred for 1 hr. Then, the resultant mixture was filtered under pressure using a polyvinylidenefluoride membrane filter having an average aperture of 5.0 μm to prepare an inkjet ink 1.

(Preparation of Inkjet Ink 2)

Twenty one point eight (21.8) parts of 1,3-butanediol and 14.5 parts of glycerin as wetters, 1 part of 2-ethyl-1,3-hexanediol and 1 part of 2,2,4-trimethyl-1,3-pentanediol as penetrants, 0.05 pans of antifungal agent Proxel GXL (from Arch Chemicals Japan. Inc.) and 8.02 parts of water were stirred for 1 hr to be mixed. Next, 53.33 parts of the resin-coated magenta pigment dispersion, 0.1 parts of a defoamer AD-01 (from Nissin Chemical Industry Co., Ltd.) and 0.2 parts of a pH adjuster 2-amino-2-ethyl-1,3-propanedol were added to the mixture, and the mixture was stirred for 1 hr. Then, the resultant mixture was filtered under pressure using a polyvinylidenefluoride membrane filter having an average aperture of 5.0 μm to prepare an inkjet ink 2.

(Preparation of after-Treatment Liquid 1)

Twenty two (22) parts of 3-methyl-1,3-butanediol and 11 parts of glycerin as wetters, 2 parts of 2-ethyl-1,3-hexanediol as a penetrant, 0.05 parts of fluorine-containing surfactant DSN-403N (from Daikin Industries, Ltd.), 0.05 parts of antifungal agent Proxel GXL (from Arch Chemicals Japan, Inc.) and 35.6 parts of water were stirred for 1 hr to be mixed. Next, 15 parts of an acryl-modified polyurethane emulsion SU-100N (from CSC Co., Ltd.) including a solid content of 35% by weight and having a median diameter of 0.06 μm, 14 parts of oxidized polyethylene wax emulsion AQUACER-515 (from BYK Chemie GmbH) including a solid content of 35% by weight, 0.1 parts of a defoamer AD-01 (from Nissin Chemical Industry Co., Ltd.) and 0.2 parts of a pH adjuster 2-amino-2-ethyl-1,3-propanedol were added to the mixture, and the mixture was stirred for 1 hr. Then, the resultant mixture was filtered under pressure using a polyvinylidenefluoride membrane filter having an average aperture of 5.0 μm to prepare an after-treatment liquid 1.

(Preparation of after-Treatment Liquid 2)

One point five (1.5) parts of a polyether-modified polydimethylsiloxane BYK-333 (from BYK Chemie GmbH), 22 parts of 3-methyl-1,3-butanediol and 11 parts of glycerin as wetters, 2 parts of 2-ethyl-1,3-hexanediol as a penetrant, 0.05 parts of fluorine-containing surfactant DSN-403N (from Daikin Industries, Ltd.), 0.05 parts of antifungal agent Proxel GXL (from Arch Chemicals Japan, Inc.) and 39.6 parts of water were stirred for 1 hr to be mixed. Next, 15 parts of an acryl-modified polyurethane emulsion SU-100N (from CSC Co., Ltd.) including a solid content of 35% by weight and having a median diameter of 0.06 μm, 8.5 parts of oxidized polyethylene wax emulsion AQUACER-515 (from BYK Chemie GmbH) including a solid content of 35% by weight, 0.1 parts of a defoamer AD-01 (from Nissin Chemical Industry Co., Ltd.) and 0.2 parts of a pH adjuster 2-amino-2-ethyl-1,3-propanedol were added to the mixture, and the mixture was stirred for 1 hr. Then, the resultant mixture was filtered under pressure using a polyvinylidenefluoride membrane filter having an average aperture of 5.0 μm to prepare an after-treatment liquid 2.

(Preparation of after-Treatment Liquid 3)

The procedure for preparation of the after-treatment liquid 1 was repeated except for replacing the acryl-modified polyurethane emulsion with a styrene-acrylic acid copolymer.

Example 1

A solid image having an image resolution of 1200 dpi was formed on a coated paper for commercial printing by the image forming apparatus 100 in FIGURE with the inkjet ink 1 and the after-treatment liquid 1. Lumi Art Gross paper (from Stora Enso) having a weight of 90 g/m$^2$ and a transfer amount of pure water of 2.3 mL/m$^2$ when contacting thereto for 100 ms was used as the coated paper for commercial printing. Further, the inkjet ink 1 and the after-treatment liquid 1 adhered to the coated paper for commercial printing in an amount of 9.5 g/m$^2$ and 3 g/m$^2$ (solid content), respectively.

Example 2

The procedure for forming the solid image in Example 1 was repeated except for further using the pre-treatment liquid 1.

Example 3

The procedure for forming the solid image in Example 1 was repeated except for using OK Top coat+from Oji Paper Co., Ltd. having a weight of 104.7 g/m$^2$ and a transfer amount of pure water of 3.1 mL/m$^2$ when contacting thereto for 100 ms as the coated paper for commercial printing.

Example 4

The procedure for forming the solid image in Example 1 was repeated except for using Space DX from Nippon Paper Industries Co., Ltd. having a weight of 56.5 g/m$^2$ and a transfer amount of pure water of 9.9 mL/m$^2$ when contacting thereto for 100 ms as the coated paper for commercial printing.

Example 5

The procedure for forming the solid image in Example 1 was repeated except for replacing the after-treatment liquid 1 with the after-treatment liquid 2.

Example 6

The procedure for forming the solid image in Example 1 was repeated except for replacing the inkjet ink 1 with the inkjet ink 2.

Comparative Example 1

The procedure for forming the solid image in Example 1 was repeated except for not using the after-treatment liquid 1.

Comparative Example 2

The procedure for forming the solid image in Example 1 was repeated except for replacing the after-treatment liquid 1 with the after-treatment liquid 3.

(Preparation of Pre-Treatment Liquid 2)

After 44 parts of polyamine derivative DK6810 (from Seiko PMC Corp.), 42 parts of ammonium lactate, 2 parts of nonionic surfactant LS-106 (from Kao Corp.), 1 part of antifungal agent Proxel GXL (from Arch Chemicals Japan. Inc.), 0.1 parts of antirust agent 1,2,3-benzotriazole, 0.1 parts of AD-01 (from Nissin Chemical Industry Co., Ltd.) and 0.8 parts of a pH adjuster 2-amino-2-ethyl-1,3-propanedol were stirred for 1 hr, the resultant mixture was filtered under pressure using a polyvinylidenefluoride membrane filter having an average aperture of 5.0 μm to prepare a pre-treatment liquid 2.

(Preparation of after-Treatment Liquid 4)

Twenty two (22) parts of 3-methyl-1,3-butanediol and 11 parts of glycerin as wetters, 2 parts of 2-ethyl-1,3-hexanediol as a penetrant, 0.05 parts of fluorine-containing surfactant DSN-403N (from Daikin Industries, Ltd.), 0.05 parts of antifungal agent Proxel GXL (from Arch Chemicals Japan, Inc.) and 41.03 parts of water were stirred for 1 hr to be mixed. Next, 15 parts of an acryl-modified polyurethane emulsion SU-100N (from CSC Co., Ltd.) including a solid content of 35% by weight and having a median diameter of 0.06 μm, 8.57 parts of mixed wax emulsion AQUACER-539 (from BYK Chemie GmbH) including a solid content of 35% by weight, 0.1 parts of a defoamer AD-01 (from Nissin Chemical Industry Co., Ltd.) and 0.2 parts of a pH adjuster 2-amino-2-ethyl-1,3-propenedol were added to the mixture, and the mixture was stirred for 1 hr. Then, the resultant mixture was filtered under pressure using a polyvinylidenefluoride membrane filter having an average aperture of 5.0 μm to prepare an after-treatment liquid 4.

(Preparation of after-Treatment Liquid 5)

The procedure for preparation of the after-treatment liquid 4 was repeated except for replacing the mixed wax emulsion with a paraffin wax emulsion AQUACER-498 including a solid content of 50% by weight (from BYK Chemie GmbH).

(Preparation of after-Treatment Liquid 6)

Twenty two (22) parts of 3-methyl-1,3-butanediol and 11 parts of glycerin as wetters, 2 parts of 2-ethyl-1,3-hexanediol as a penetrant, 0.05 parts of fluorine-containing surfactant DSN-403N (from Daikin Industries, Ltd.), 0.05 parts of antifungal agent Proxel GXL (from Arch Chemicals Japan. Inc.) and 42.31 parts of water were stirred for 1 hr to be mixed. Next, 15 pats of an acryl-modified polyurethane emulsion SU-100N (from CSC Co., Ltd.) including a solid content of 35% by weight and having a median diameter of 0.06 μm, 4.29 parts of oxidized polyethylene wax emulsion AQUACER-515 (from BYK Chemie GmbH) including a solid content of 35% by weight, 3 parts of a paraffin wax emulsion AQUACER-498 including a solid content of 50% by weight (from BYK Chemie GmbH), 0.1 parts of a defoamer AD-01 (from Nissin Chemical Industry Co., Ltd.) and 0.2 parts of a pH adjuster 2-amino-2-ethyl-1,3-propanedol were added to the mixture, and the mixture was stirred for 1 hr. Then, the resultant mixture was filtered under pressure using a polyvinylidenefluoride membrane filter having an average aperture of 5.0 μm to prepare an after-treatment liquid 6.

(Preparation of after-Treatment Liquid 7)

The procedure for preparation of the after-treatment liquid 6 was repeated except for changing additive amounts of the water, the oxidized polyethylene wax emulsion and the paraffin wax emulsion into 42.83, 2.57 and 4.2, respectively.

(Preparation of after-Treatment Liquid 8)

The procedure for preparation of the after-treatment liquid 6 was repeated except for changing additive amounts of the water, the oxidized polyethylene wax emulsion and the paraffin wax emulsion into 43.34, 0.86 and 5.4, respectively.

(Preparation of after-Treatment Liquid 9)

Twenty two (22) parts of 3-methyl-1,3-butanediol and 11 parts of glycerin as wetters, 2 parts of 2-ethyl-1,3-hexanediol as a penetrant, 0.05 parts of fluorine-containing surfactant DSN-403N (from Daikin Industries, Ltd.), 0.05 parts of antifungal agent Proxel GXL (from Arch Chemicals Japan, Inc.) and 43.6 parts of water were stirred for 1 hr to be mixed. Next, 15 parts of an acryl-modified polyurethane emulsion SU-100N (from CSC Co., Ltd.) including a solid content of 35% by weight and having a median diameter of 0.06 μm, 6 parts of a paraffin wax emulsion AQUACER-498 including a solid content of 50% by weight (from BYK Chemie GmbH), 0.1 parts of a defoamer AD-01 (from Nissin Chemical Industry Co., Ltd.) and 0.2 parts of a pH adjuster 2-amino-2-ethyl-1,3-propanedol were added to the mixture, and the mixture was stirred for 1 hr. Then, the resultant mixture was filtered under pressure using a polyvinylidenefluoride membrane filter having an average aperture of 5.0 μm to prepare an after-treatment liquid 9.

(Preparation of after-Treatment Liquid 10)

Twenty two (22) parts of 3-methyl-1,3-butanediol and 11 parts of glycerin as wetters, 2 parts of 2-ethyl-1,3-hexanediol as a penetrant, 0.05 parts of fluorine-containing surfactant DSN-403N (from Daikin Industries. Ltd.), 0.05 parts of antifungal agent Proxel GXL (from Arch Chemicals Japan, Inc.) and 49.6 parts of water were stirred for 1 hr to be mixed. Next, 15 parts of an acryl-modified polyurethane emulsion SU-100N (from CSC Co., Ltd.) including a solid content of 35% by weight and having a median diameter of 0.06 μm, 0.1 parts of a defoamer AD-01 (from Nissin Chemical Industry Co., Ltd.) and 0.2 parts of a pH adjuster 2-amino-2-ethyl-1, 3-propanedol were added to the mixture, and the mixture was stirred for 1 hr. Then, the resultant mixture was filtered under pressure using a polyvinylidenefluoride membrane filter having an average aperture of 5.0 μm to prepare an after-treatment liquid 10.

Example 7

The procedure for forming the solid image in Example 1 was repeated except for replacing the after-treatment liquid 1 with the after-treatment liquid 4.

Example 8

The procedure for forming the solid image in Example 7 was repeated except for further using the pre-treatment liquid 2.

Example 9

The procedure for forming the solid image in Example 7 was repeated except for using OK Top coat+from Oji Paper Co., Ltd. having a weight of 104.7 g/m$^2$ and a transfer amount of pure water of 3.1 mL/m$^2$ when contacting thereto for 100 ms as the coated paper for commercial printing.

Example 10

The procedure for forming the solid image in Example 1 was repeated except for replacing the after-treatment liquid 1 with the after-treatment liquid 5.

Example 11

The procedure for forming the solid image in Example 1 was repeated except for replacing the after-treatment liquid 1 with the after-treatment liquid 6.

Example 12

The procedure for forming the solid image in Example 1 was repeated except for replacing the after-treatment liquid 1 with the after-treatment liquid 7.

Example 13

The procedure for forming the solid image in Example 1 was repeated except for replacing the after-treatment liquid 1 with the after-treatment liquid 8.

Example 14

The procedure for forming the solid image in Example 1 was repeated except for replacing the after-treatment liquid 1 with the after-treatment liquid 9.

Example 15

The procedure for forming the solid image in Example 7 was repeated except for replacing the inkjet ink 1 with the inkjet ink 2.

Comparative Example 3

The procedure for forming the solid image in Example 1 was repeated except for replacing the after-treatment liquid 1 with the after-treatment liquid 10.

(Preparation of after-Treatment Liquid 11)

The procedure for preparation of the after-treatment liquid 1 was repeated except for replacing the acryl-modified polyurethane emulsion with a carbonate-modified polyurethane emulsion XP2648/1 (from Sumitomo Bayer Urethane Co., Ltd.) including a solid content of 35% by weight and having a median diameter of 0.05 μm.

(Preparation of after-Treatment Liquid 12)

The procedure for preparation of the after-treatment liquid 2 was repeated except for replacing the acryl-modified polyurethane emulsion with a carbonate-modified polyurethane emulsion XP2648/1 (from Sumitomo Bayer Urethane Co., Ltd.) including a solid content of 35% by weight and having a median diameter of 0.05 μm.

Example 16

The procedure for forming the solid image in Example 1 was repeated except for replacing the after-treatment liquid 1 with the after-treatment liquid 11.

Example 17

The procedure for forming the solid image in Example 16 was repeated except for further using the pre-treatment liquid 2.

Example 18

The procedure for forming the solid image in Example 16 was repeated except for using OK Top coat+from Oji Paper Co., Ltd. having a weight of 104.7 g/m$^2$ and a transfer amount of pure water of 3.1 mL/m$^2$ when contacting thereto for 100 ms as the coated paper for commercial printing.

Example 19

The procedure for forming the solid image in Example 1 was repeated except for replacing the after-treatment liquid 1 with the after-treatment liquid 12.

Example 20

The procedure for forming the solid image in Example 16 was repeated except for replacing the inkjet ink 1 with the inkjet ink 2.

(Preparation of after-Treatment Liquid 13)

The procedure for preparation of the after-treatment liquid 1 was repeated except for using AQUACER-513 (from BYK Chemie GmbH) including a solid content of 35% by weight as the oxidized polyethylene wax emulsion.

(Preparation of after-Treatment Liquid 14)

The procedure for preparation of the after-treatment liquid 1 was repeated except for using SU-100N (from CSC Co., Ltd.) including a solid content of 35% by weight and having a median diameter of 0.13 μm as the acryl-modified polyurethane emulsion.

(Preparation of after-Treatment Liquid 15)

The procedure for preparation of the after-treatment liquid 1 was repeated except for using SU-100N (from CSC Co., Ltd.) including a solid content of 35% by weight and having a median diameter of 0.008 μm as the acryl-modified polyurethane emulsion.

Example 21

The procedure for forming the solid image in Example 1 was repeated except for replacing the after-treatment liquid 1 with the after-treatment liquid 13.

Comparative Example 4

The procedure for forming the solid image in Example 1 was repeated except for replacing the after-treatment liquid 1 with the after-treatment liquid 14.

Comparative Example 5

The procedure for forming the solid image in Example 1 was repeated except for replacing the after-treatment liquid 1 with the after-treatment liquid 15.

(Preparation of Pre-Treatment Liquid 3)

Thirty (30) parts of polyamine derivative DK6810 (from Seiko PMC Corp.), 27 parts of ammonium lactate, 2 parts of nonionic surfactant LS-106 (from Kao Corp.), 1 part of antifungal agent Proxel GXL (from Arch Chemicals Japan, Inc.) and 0.1 parts of antirust agent 1,2,3-benzotriazole were stirred for 1 hr to be mixed. Next, 15 parts of an acryl-modified polyurethane emulsion SU-100N (from CSC Co., Ltd.) including a solid content of 35% by weight and having a median diameter of 0.06 μm, 14 parts of the oxidized polyethylene wax emulsion AQUACER-515 including a solid content of 50% by weight (from BYK Chemie GmbH), 0.1 parts of a defoamer AD-01 (from Nissin Chemical Industry Co., Ltd.) and 0.8 parts of a pH adjuster 2-amino-2-ethyl-1,3-propanedol were added to the mixture, mixture, and the mixture was stirred for 1 hr. Then, the resultant mixture was filtered under pressure using a polyvinylidenefluoride membrane filter having an average aperture of 5.0 μm to prepare a pre-treatment liquid 3.

(Preparation of Pre-Treatment Liquid 4)

One point five (1.5) of the polyether-modified polydimethylsiloxane BYK-333 (from BYK Chemie GmbH), 30 parts of polyamine derivative DK6810 (from Seiko PMC Corp.), 25.5 parts of ammonium lactate, 2 parts of nonionic surfactant LS-106 (from Kao Corp.), 1 part of antifungal agent Proxel GXL (from Arch Chemicals Japan, Inc.) and 0.1 parts of antirust agent 1,2,3-benzotriazole were stirred for 1 hr to be mixed. Next, 15 parts of an acryl-modified polyurethane emulsion SU-100N (from CSC Co., Ltd.) including a solid content of 35% by weight and having a median diameter of 0.06 μm, 14 parts of the oxidized polyethylene wax emulsion AQUACER-515 including a solid content of 50% by weight (from BYK Chemie GmbH), 0.1 parts of a defoamer AD-01 (from Nissin Chemical Industry Co., Ltd.) and 0.8 parts of a pH adjuster 2-amino-2-ethyl-1,3-propanedol were added to the mixture, and the mixture was stirred for 1 hr. Then, the resultant mixture was filtered under pressure using a polyvinylidenefluoride membrane filter having an average aperture of 5.0 μm to prepare a pre-treatment liquid 3.

Example 22

The procedure for forming the solid image in Example 17 was repeated except for applying the after-treatment liquid 11 on almost all area of the surface the inkjet ink is applied on of the coated paper for commercial printing.

Example 23

The procedure for forming the solid image in Example 17 was repeated except for replacing the pre-treatment liquid 2 with the pre-treatment liquid 3.

Example 24

The procedure for forming the solid image in Example 17 was repeated except for replacing the pre-treatment liquid 2 with the pre-treatment liquid 4.

Example 25

The procedure for forming the solid image in Example 1 was repeated except for using POD Gloss Coat 100 from Oji Paper Co., Ltd. having a weight of 100 g/m$^2$ and a transfer amount of pure water of 2.1 mL/m$^2$ when contacting thereto for 100 ms as the coated paper for commercial printing.

Example 26

The procedure for forming the solid image in Example 24 was repeated except for using POD Gloss Coat 100 from Oji Paper Co., Ltd. having a weight of 100 g/m$^2$ and a transfer amount of pure water of 2.1 mL/m$^2$ when contacting thereto for 100 ms as the coated paper for commercial printing.

Next, image density, smear fixability, spur trace, glossiness, anti-blocking and friction coefficient of the solid images formed in the Examples and Comparative Examples were evaluated.

<Image Density>

The image density of the solid image was measured by a reflection-type color spectrum densitometer from X-Rite, Inc.

<Smear Fixability>

After 3 hrs passed after the solid image was formed, a clock meter (from Toyo Seiki Seisaku-sho, Ltd.) was reciprocated for 10 times to scrape the solid image with a white cotton cloth fitted thereto. The ink contamination adhering to the white cotton cloth was visually observed to evaluate smear fixability. The contamination was graded as follows.

5: No contamination
4: Slight contamination
3: Contaminated, but no problem in practical use
2: Slightly noticeable contamination
1: Noticeable contamination <Spur Trace>

The spur trace was visually observed and graded as follows.

Excellent: No spur trace
Good: Slight spur trace
Poor: Obvious sour trace

<Glossiness>

60° glossiness of the solid image was measured by a gloss meter Micro-Gross 60° (from ATRUS CO., LTD.)<

<Anti-Blocking>

The anti-blocking was evaluated according to TAPPI T477 test method published by Japan Technical Association of the Pulp and Paper Industry. Specifically, on a 10 cm×10 cm glass plate, after a 6 cm×6 cm coated paper for commercial printing the solid image is formed on and a blank coated paper for commercial printing are overlaid each other, another 10 cm×10 cm glass plate was loaded on them. A load of 1 kg/m$^2$ was applied on them and left for 24 hrs in an environment of 40° C. and 90% RH. Then, they were left for 2 hrs at room temperature and peeled to visually observe adherence thereof. The anti-blocking was graded as follows.

Excellent: The adjacent surfaces were freely slidable
Good: The adjacent surfaces were not freely slidable, but slidable with pressure and friction
Fair: The adjacent surfaces were not easily slidable
Poor: The adjacent surfaces completely bonded together <Friction Coefficient>

According to JIS P8147: 2010 Paper and Paper Board-Static and Dynamic friction coefficient measurement method, the friction coefficient was measured by a surfaceness measurer HEIDON Tribogear Type: 14DR (from Shinto Scientific Co., Ltd.). Specifically, a 7 cm×8 cm solid image was set on the bottom of the measurer. Next, a 6.5 cm×12 cm solid image was set on the upper side while the surface the image is formed on or not formed was fitted to an ASTM plane indenter including a rubber backing. Further, a load of 800 g/m$^2$ was applied and moved for 6 cm at 1200 mm/min to measure friction coefficients (fronts each other) or (front and back).

The evaluation results are shown in Tables 1 and 2.

TABLE 1

| | Image Density | Smear fixability | Spur trace | Glossiness Image | Glossiness Non-image | Anti-blocking |
|---|---|---|---|---|---|---|
| Example 1 | 2.51 | 4 | Good | 31 | 20 | Good |
| Example 2 | 2.46 | 4 | Good | 32 | 21 | Good |
| Example 3 | 2.54 | 4 | Good | 43 | 30 | Good |
| Example 4 | 2.38 | 4 | Excellent | 50 | 55 | Good |
| Example 5 | 2.61 | 5 | Excellent | 37 | 20 | Good |
| Example 6 | 1.65 | 4 | Good | 31 | 20 | Good |
| Example 7 | 2.48 | 4 | Good | 30 | 20 | Excellent |
| Example 8 | 2.46 | 4 | Good | 32 | 21 | Good |
| Example 9 | 2.54 | 4 | Good | 43 | 30 | Excellent |
| Example 10 | 2.51 | 4 | Good | 31 | 20 | Good |
| Example 11 | 2.53 | 4 | Good | 31 | 20 | Excellent |
| Example 12 | 2.55 | 4 | Good | 30 | 20 | Excellent |
| Example 13 | 2.57 | 4 | Good | 29 | 20 | Excellent |
| Example 14 | 2.61 | 4 | Good | 28 | 20 | Excellent |
| Example 15 | 1.67 | 4 | Good | 31 | 20 | Excellent |
| Example 16 | 2.48 | 4 | Good | 32 | 20 | Excellent |
| Example 17 | 2.46 | 4 | Good | 34 | 21 | Good |
| Example 18 | 2.54 | 4 | Good | 45 | 30 | Excellent |
| Example 19 | 2.51 | 4 | Good | 33 | 20 | Good |
| Example 20 | 1.67 | 4 | Good | 33 | 20 | Excellent |
| Example 21 | 2.52 | 4 | Good | 35 | 20 | Excellent |
| Example 22 | 2.51 | 4 | Good | 34 | 15 | Excellent |
| Example 23 | 2.50 | 4 | Good | 34 | 21 | Excellent |
| Example 24 | 2.53 | 4 | Good | 34 | 21 | Excellent |
| Example 25 | 2.52 | 4 | Good | 35 | 24 | Excellent |
| Example 26 | 2.48 | 4 | Good | 54 | 31 | Excellent |
| Comparative Example 1 | 2.46 | 2 | Poor | 18 | 20 | Poor |
| Comparative Example 2 | 2.54 | 4 | Good | 30 | 20 | Poor |
| Comparative Example 3 | 2.46 | 2 | Fair | 31 | 20 | Fair |
| Comparative Example 4 | 2.21 | 4 | Good | 25 | 20 | Fair |
| Comparative Example 5 | 2.65 | 4 | Good | 41 | 20 | Fair |

TABLE 2

| | Static friction coefficient: Fronts each other | Static friction coefficient: Front and back | Dynamic friction coefficient: Fronts each other | Dynamic friction coefficient: Front and back |
|---|---|---|---|---|
| Example 1 | 0.39 | 0.39 | 0.19 | 0.20 |
| Example 2 | 0.37 | 0.38 | 0.17 | 0.18 |
| Example 3 | 0.41 | 0.42 | 0.21 | 0.22 |
| Example 4 | 0.40 | 0.45 | 0.21 | 0.24 |
| Example 5 | 0.30 | 0.36 | 0.15 | 0.18 |
| Example 6 | 0.37 | 0.38 | 0.18 | 0.18 |
| Example 7 | 0.56 | 0.55 | 0.21 | 0.20 |
| Example 8 | 0.57 | 0.58 | 0.25 | 0.23 |

TABLE 2-continued

| | Static friction coefficient: Fronts each other | Static friction coefficient: Front and back | Dynamic friction coefficient: Fronts each other | Dynamic friction coefficient: Front and back |
|---|---|---|---|---|
| Example 9 | 0.61 | 0.63 | 0.24 | 0.24 |
| Example 10 | 0.39 | 0.39 | 0.19 | 0.20 |
| Example 11 | 0.52 | 0.50 | 0.21 | 0.22 |
| Example 12 | 0.57 | 0.56 | 0.22 | 0.23 |
| Example 13 | 0.61 | 0.62 | 0.25 | 0.25 |
| Example 14 | 0.65 | 0.64 | 0.25 | 0.27 |
| Example 15 | 0.59 | 0.56 | 0.23 | 0.21 |
| Example 16 | 0.29 | 0.34 | 0.17 | 0.22 |
| Example 17 | 0.27 | 0.33 | 0.15 | 0.20 |
| Example 18 | 0.31 | 0.37 | 0.19 | 0.24 |
| Example 19 | 0.20 | 0.29 | 0.13 | 0.20 |
| Example 20 | 0.27 | 0.31 | 0.16 | 0.20 |
| Example 21 | 0.30 | 0.36 | 0.16 | 0.22 |
| Example 22 | 0.27 | 0.33 | 0.15 | 0.20 |
| Example 23 | 0.32 | 0.37 | 0.20 | 0.23 |
| Example 24 | 0.28 | 0.32 | 0.16 | 0.21 |
| Example 25 | 0.34 | 0.36 | 0.23 | 0.24 |
| Example 26 | 0.41 | 0.40 | 0.25 | 0.23 |
| Comparative Example 1 | Measurement upper limit | Measurement upper limit | 0.70 | 0.70 |
| Comparative Example 2 | Measurement upper limit | 2.31 | 0.72 | 0.70 |
| Comparative Example 3 | 1.07 | 0.75 | 0.50 | 0.39 |
| Comparative Example 4 | 1.25 | 0.62 | 0.43 | 0.51 |
| Comparative Example 5 | 1.05 | 0.58 | 0.51 | 0.53 |

Tables 1 and 2 prove Examples 1 to 26 have good fixability (smear fixability and spur trace) and anti-blocking.

Comparative Example 1 deteriorates in fixability and anti-blocking because of not using the after-treatment liquid.

Comparative Examples 2 deteriorates in anti-blocking because the after-treatment liquid does not include the water-dispersible polyurethane.

Comparative Example 3 deteriorates in fixability and anti-blocking because the after-treatment liquid does not include the polyethylene wax or the paraffin wax.

Comparative Examples 4 deteriorates in anti-blocking because the after-treatment liquid includes a water-dispersible polyurethane having a median diameter of 0.13 μm.

Comparative Examples 5 deteriorates in anti-blocking because the after-treatment liquid includes a water-dispersible polyurethane having a median diameter of 0.008 μm.

Having now fully described the invention, it will be apparent to one of ordinary skill in the art that many changes and modifications can be made thereto without departing from the spirit and scope of the invention as set forth therein.

What is claimed is:

1. An image forming method, comprising:

discharging an inkjet ink comprising a water-dispersible colorant, a wetter, a surfactant, a penetrant and water on a surface of a recording medium; and applying an after-treatment liquid comprising a water-dispersible polyurethane resin having a median diameter of from 0.01 to 0.10 μm, water and at least one of a polyethylene wax and a paraffin wax on the surface of the recording medium on which the inkjet ink is discharged.

2. The image forming method of claim 1, wherein the water-dispersible polyurethane resin is an acryl-modified polyurethane resin or a carbonate-modified polyurethane resin.

3. The image forming method of claim 1, wherein the after-treatment liquid comprises the polyethylene wax such that a weight ratio of the water-dispersible polyurethane resin to the polyethylene wax is from 1 to 10.

4. The image forming method of claim 1, wherein the after-treatment liquid comprises the polyethylene wax and the paraffin wax such that a weight ratio of the paraffin wax to the polyethylene wax is from 1 to 9.

5. The image forming method of claim 1, wherein the after-treatment liquid further comprises polyether-modified polydimethylsiloxane.

6. The image forming method of claim 1, further comprising:

applying a pre-treatment liquid comprising amine on the surface of the recording medium; and discharging the inkjet ink on the surface thereof on which the pre-treatment liquid is applied.

7. The image forming method of claim 6, wherein the pre-treatment liquid further comprises the water-dispersible polyurethane resin having a median diameter of from 0.01 to 0.10 μm, and at least one of the polyethylene wax and the paraffin wax.

8. The image forming method of claim 6, wherein the pre-treatment liquid further comprises polyether-modified polydimethylsiloxane.

9. The image forming method of claim 1, wherein the recording medium comprises:

a substrate; and a coated layer formed on one side or both sides of the substrate, wherein pure water transfers to the recording medium in an amount of form 1 to 10 $mL/m^2$ when contacting the surface thereof on which the coated layer is formed for 100 ms.

10. An image forming apparatus, comprising:

a discharger configured to discharge an inkjet ink comprising a water-dispersible colorant, a wetter, a surfactant, a penetrant and water on a surface of a recording medium; and an applicator configured to apply an after-treatment liquid comprising a water-dispersible polyurethane resin having a median diameter of from 0.01 to 0.10 μm, water and at least one of a polyethylene wax and a paraffin wax on the surface of the recording medium on which the inkjet ink is discharged.

* * * * *